US011160719B2

(12) United States Patent
Ploss et al.

(10) Patent No.: US 11,160,719 B2
(45) Date of Patent: Nov. 2, 2021

(54) THERAPEUTIC ROLLER WITH COUPLING AND NON-COUPLING NODULES

(71) Applicant: Stamina Products, Inc., Springfield, MO (US)

(72) Inventors: Peter Douglas Ploss, Shell Knob, MO (US); Jeffrey Taylor Hutchens, Springfield, MO (US); Matthew Blake Gremling, Republic, MO (US); Spencer William Laurie, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 376 days.

(21) Appl. No.: 16/290,341

(22) Filed: Mar. 1, 2019

(65) Prior Publication Data

US 2020/0276078 A1 Sep. 3, 2020

(51) Int. Cl.
*A61H 15/00* (2006.01)

(52) U.S. Cl.
CPC . *A61H 15/0092* (2013.01); *A61H 2015/0014* (2013.01); *A61H 2201/0107* (2013.01); *A61H 2201/1685* (2013.01); *A61H 2201/1695* (2013.01)

(58) Field of Classification Search
CPC ..... A61H 15/00; A61H 15/0092; A61H 2201/1284; A61H 2201/0107; A61H 2201/1685; A61H 2201/1692; A61H 2201/1695; A63B 22/20; A63B 22/203
USPC ..... 24/72.7
See application file for complete search history.

(56) References Cited

U.S. PATENT DOCUMENTS

| | | | | |
|---|---|---|---|---|
| 4,210,134 | A * | 7/1980 | Okazaki | A61H 39/04 5/421 |
| 5,266,069 | A | 11/1993 | Thorne | |
| 5,824,013 | A | 10/1998 | Allen | |
| 5,830,161 | A | 11/1998 | Cosmano | |
| 5,860,229 | A | 1/1999 | Morgenstern | |
| 7,013,588 | B2 | 3/2006 | Chang | |
| 7,108,646 | B1 | 9/2006 | Quick | |
| 7,918,774 | B2 | 4/2011 | Dye | |
| 7,998,031 | B2 | 8/2011 | Dumke et al. | |
| 8,002,682 | B2 | 8/2011 | Dye | |
| 8,672,818 | B2 | 3/2014 | Welch | |
| 9,005,146 | B2 | 4/2015 | Phillips | |
| 9,044,373 | B2 | 6/2015 | Welch | |
| 9,144,701 | B2 | 9/2015 | Chen | |
| D749,233 | S | 2/2016 | Phillips | |
| D755,304 | S | 5/2016 | Ackerman | |
| 9,345,921 | B2 | 5/2016 | Dye | |

(Continued)

*Primary Examiner* — Colin W Stuart
*Assistant Examiner* — Douglas Y Sul
(74) *Attorney, Agent, or Firm* — Erise IP, P.A.

(57) ABSTRACT

A therapeutic roller system for use in myofascial release. The therapeutic roller system includes a hollow roller and a coupling nodule. The hollow roller presents an outer wall. The hollow roller includes a receptor opening traversing the outer wall. The coupling nodule includes an upper therapeutic segment and a lower locking segment. The lower locking segment is configured to be inserted into the receptor opening in a first orientation. The lower locking segment is configured to be secured within the receptor opening in a second orientation. The therapeutic roller system may further include a non-coupling nodule.

20 Claims, 8 Drawing Sheets

(56) References Cited

U.S. PATENT DOCUMENTS

| | | | | |
|---|---|---|---|---|
| D759,259 | S | 6/2016 | Phillips | |
| 9,539,167 | B2 | 1/2017 | Dye | |
| 9,616,313 | B2 | 4/2017 | Townsend | |
| 9,656,112 | B2 | 5/2017 | Dye | |
| D796,053 | S | 8/2017 | Phillips | |
| 9,763,850 | B2 | 9/2017 | Cheng | |
| 9,821,185 | B2 | 11/2017 | Welch | |
| 9,968,513 | B1 | 5/2018 | Marton et al. | |
| 10,071,014 | B2 | 9/2018 | Yeh | |
| 10,675,215 | B1 * | 6/2020 | Yoon | A61H 7/001 |
| 2002/0193714 | A1 | 12/2002 | Pecora | |
| 2004/0176710 | A1 * | 9/2004 | Kennedy | A61H 23/04 601/55 |
| 2004/0204664 | A1 | 10/2004 | Chu | |
| 2005/0085749 | A1 | 4/2005 | Baerwalde et al. | |
| 2005/0215928 | A1 | 9/2005 | Banks et al. | |
| 2006/0142677 | A1 | 6/2006 | Perez | |
| 2007/0129654 | A1 | 6/2007 | Anderson | |
| 2007/0131838 | A1 * | 6/2007 | Okamoto | G09F 7/06 248/560 |
| 2008/0039747 | A1 | 2/2008 | Baerwalde et al. | |
| 2008/0086066 | A1 * | 4/2008 | Munday | A61H 39/04 601/135 |
| 2010/0145240 | A1 | 6/2010 | Cromie | |
| 2011/0009248 | A1 * | 1/2011 | Bronston | A63B 21/153 482/124 |
| 2013/0267396 | A1 | 10/2013 | Dye | |
| 2015/0045707 | A1 | 2/2015 | Selvaggio | |
| 2015/0080774 | A1 * | 3/2015 | Olaya | A61H 15/00 601/121 |
| 2015/0257969 | A1 | 9/2015 | Shannon | |
| 2015/0283023 | A1 | 10/2015 | Phillips | |
| 2016/0081873 | A1 | 3/2016 | Sims | |
| 2016/0235619 | A1 * | 8/2016 | Yeh | A61H 15/00 |
| 2016/0331628 | A1 | 11/2016 | Kuo | |
| 2017/0007495 | A1 | 1/2017 | Norwood et al. | |
| 2017/0020771 | A1 | 1/2017 | Shannon | |
| 2017/0020774 | A1 | 1/2017 | Rocklin et al. | |
| 2017/0071817 | A1 | 3/2017 | Sanchez | |
| 2017/0080283 | A1 | 3/2017 | Harman | |
| 2017/0189260 | A1 | 7/2017 | Chen | |
| 2017/0202729 | A1 | 7/2017 | Lin | |
| 2017/0202730 | A1 | 7/2017 | Lin | |
| 2017/0216133 | A1 | 8/2017 | Yih | |
| 2017/0231851 | A1 | 8/2017 | Faussett | |
| 2017/0239133 | A1 | 8/2017 | Dye | |
| 2017/0246077 | A1 | 8/2017 | Dye | |
| 2017/0252262 | A1 * | 9/2017 | Chang | A61H 15/00 |
| 2017/0319900 | A1 | 11/2017 | Ballo et al. | |
| 2018/0125745 | A1 | 5/2018 | Olaya | |
| 2018/0207054 | A1 | 7/2018 | Sitsihovskiy et al. | |
| 2018/0207055 | A1 | 7/2018 | Davis et al. | |
| 2018/0228691 | A1 | 8/2018 | Marton et al. | |

* cited by examiner

THERAPEUTIC ROLLER WITH COUPLING AND NON-COUPLING NODULES

BACKGROUND

1. Field

Embodiments of the invention relate to therapeutic rollers.

2. Related Art

Therapeutic rollers, such as a foam roller, may be utilized by a user as a tool for myofascial release, physical therapy, exercise, stretching, and other purposes. Regarding myofascial release, the existing therapeutic rollers provide only a single cylindrical surface for pressing a body part against. The user is thus pressing the entire muscle against the therapeutic roller to push out excess fluid and provide new blood flow. This does not allow the user to isolate certain parts of the muscle. Thus, the user can only practice myofascial release on general muscle groups instead of targeting specific problem areas.

SUMMARY

Embodiments of the invention solve the above-mentioned problems and provide a distinct advance in the art by providing an improved therapeutic roller. In embodiments of the invention, the therapeutic roller includes a coupling nodule and a non-coupling nodule. The coupling nodule provides an isolation massage of a specific area for the user. The coupling nodule selectively adheres to the therapeutic roller such that the user may determine a position, orientation, size, shape, and/or other attributes of the coupling nodule to be used. This ability to select the attributes allows the user to more quickly and successfully conduct a myofascial release on specific areas. The non-coupling nodule provides other functions, such as holding the therapeutic roller in a certain position and orientation to assist the user in the myofascial release.

A first embodiment of the invention is generally directed to a therapeutic roller system comprising a hollow roller and a coupling nodule. The hollow roller presents an outer wall. The hollow roller includes a receptor opening traversing the outer wall. The coupling nodule includes an upper therapeutic segment and a lower locking segment. The lower locking segment is configured to be inserted into the receptor opening in a first orientation. The lower locking segment is configured to be secured within the receptor opening in a second orientation.

A second embodiment of the invention is generally directed to a coupling nodule configured to be secured to a receptor opening of a hollow roller, the coupling nodule comprising an upper therapeutic segment and a lower locking segment. The upper therapeutic segment is configured to provide myofascial release of a body part pressed thereon by a user. The lower locking segment is configured to be inserted into the receptor opening in a first orientation. The lower locking segment is configured to be secured within the receptor opening in a second orientation.

A third embodiment of the invention is generally directed to a method of myofascial release comprising: acquiring a therapeutic roller system including a hollow roller and a coupling nodule; inserting, in a first orientation, a lower locking segment of the coupling nodule into a receptor opening of the hollow roller; rotating the lower locking segment axially, to a second orientation, so as to secure the coupling nodule to the hollow roller; placing the hollow roller into a first position on a surface; pressing a body part against an upper therapeutic segment of the coupling nodule protruding radially from the hollow roller; and moving the body part relative to the upper therapeutic segment to achieve myofascial release.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
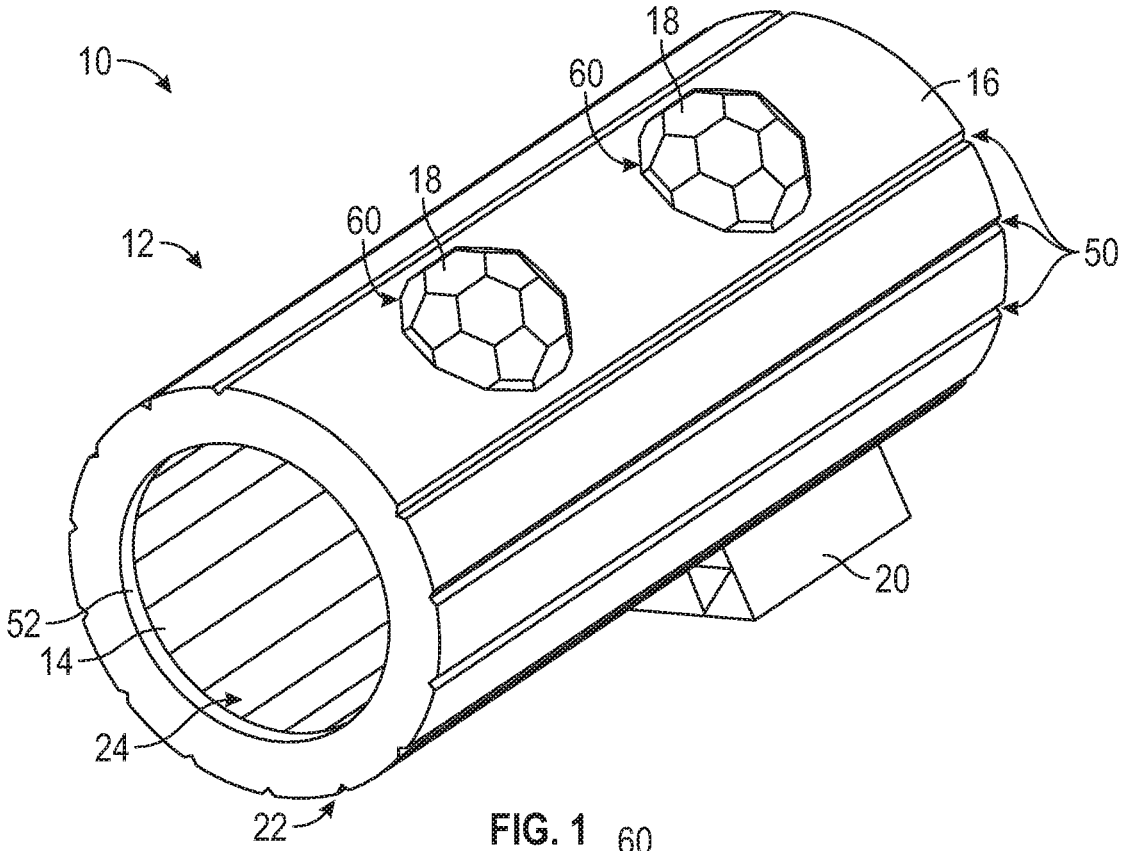
FIG. 1 is a perspective view of one embodiment of a therapeutic roller, including two coupling nodules and one non-coupling nodule.

The drawing figures do not limit the invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

As best illustrated in FIG. 1, a therapeutic roller system 10 of embodiments of the invention comprises a hollow roller 12 which includes an inner core 14 and an outer core 16, a coupling nodule 18, and a non-coupling nodule 20. In embodiments of the invention, the therapeutic roller system 10 is sold as a set, including the hollow roller 12, one or more coupling nodules 18, and one or more non-coupling nodules 20. In some embodiments, the coupling nodules 18 and/or the non-coupling nodules 20 may be sold separately. This can allow the user to select and purchase coupling nodules 18 and non-coupling nodules 20 individually such that the user can select sizes, shapes, hardness, and other attributes of the respective nodules.

Before a detailed discussion of the components of the therapeutic roller system 10, a brief discussion of an exemplary field of use of embodiments of the invention will be discussed. In embodiments of the invention, the therapeutic roller system 10 is used for myofascial release. In other embodiments, the therapeutic roller may be used for physical therapy, medical treatment, exercise, stretching, and other uses.

Myofascial release is a therapy technique utilized to treat muscular immobility, pain, and other problems. Myofascial release relaxes contracted muscles so as to improve blood flow, lymphatic circulation, and stimulate a stretch reflex. Fascia is a connective tissue that is thin, tough, and elastic. Fascia surrounds muscle and other structures within the human body. Fascia may be restricted due to overuse, trauma, infection, inactivity, and other causes. Restriction of the fascia may result in pain, muscle tension, diminished blood flow, and other symptoms. Myofascial release removes or reduces these restrictions so as to relieve the above-discussed symptoms.

Using a traditional therapeutic roller, users could cause injury to other areas while performing myofascial release because traditional therapeutic rollers did not allow for isolation massage on specific problem areas. Thus, the user would perform myofascial release on a large area while only needing myofascial release in a smaller area. These extra areas may experience injury due to unnecessary pressure put on the muscle. Embodiments of the invention may reduce the likelihood of injury to other areas by concentrating the myofascial release in a single area and may customize the size and/or shape of the area to the be treated.

Typically, the therapeutic roller system 10 is used in the following manner. First, the user will select a coupling nodule 18 for usage. The selected coupling nodule 18 may be based upon the size, shape, and orientation of the muscle (or portion thereof) to be treated. Second, the user will insert the coupling nodule 18 into the therapeutic roller and secure the coupling nodule 18 to the therapeutic roller. In the example embodiments shown in the drawings, this includes rotating the coupling nodule 18 (as discussed in depth below). Third, the user will place the therapeutic roller in a certain position and orientation. The position and orientation may be selected based upon the muscle (or portion thereof) to be treated and based upon the body position of the user to be used. Fourth, the user will place the non-coupling nodule 20 so as to secure the therapeutic roller in the position and orientation. Finally, the user will press a certain area of a body part against the coupling nodule 18 to perform myofascial release. It should be noted that the order discussed herein is only exemplary. Other orders may be used, and steps may be added or removed from the above.

In some instances, the therapeutic roller system 10 is used in conjunction with other physical therapy equipment, exercise equipment, medical equipment, or other equipment. It should be appreciated that discussed fields are only exemplary fields of use. Other fields of use for the invention include medical diagnosis, sports rehabilitation, physical therapy, occupational therapy, stretching, exercise, and other sports.

Turning to FIG. 1, the components of the therapeutic roller system 10 will now be discussed in greater detail. As discussed above, the therapeutic roller system 10 of embodiments of the invention comprises a hollow roller 12 which includes an inner core 14 and an outer core 16, a coupling nodule 18, and a non-coupling nodule 20. The inner core 14 and the outer core 16 are secured so as to form the hollow roller 12. The coupling nodule is configured to be selectively secured to and removed from the hollow roller 12. The non-coupling nodule 20 is configured to be utilized with the hollow roller 12 without directly being secured thereto.

FIG. 1 shows an embodiment of the therapeutic roller system 10. In the illustrated embodiment, the therapeutic roller system 10 includes two coupling nodules 18 which are both secured to the hollow roller 12. The therapeutic roller system 10 also includes a non-coupling nodule 20 wedged under the hollow roller 12 to hold the hollow roller 12 in a certain location and orientation. In other embodiments, the therapeutic roller system 10 may be provided with more, fewer, or no coupling nodules 18. In other embodiments, the therapeutic roller system 10 may be provided with more, fewer, or no non-coupling nodules 20. The coupling and/or non-coupling nodules 18, 20 may be provided in a bag (not illustrated) or other device for holding the coupling and/or non-coupling nodules 18, 20 for storage.

In embodiments of the invention, the hollow roller 12 includes an outer wall 22. The outer wall 22 forms a generally empty cylinder shape. Thus, the hollow roller 12 presents a cylindrical void 24 therein. The cylindrical void 24 extends at least a portion of the inner hollow roller 12. The hollow roller 12 presents a radius and a height. In some embodiments, the height is at least three times the radius, at least five times the radius, or other proportion. In some embodiments, the hollow roller 12 may be sold in various sizes and shapes. This allows the user to select the size and shape appropriate to them, in addition to the selection of coupling nodules 18 and non-coupling nodules 20.

Figure 2:
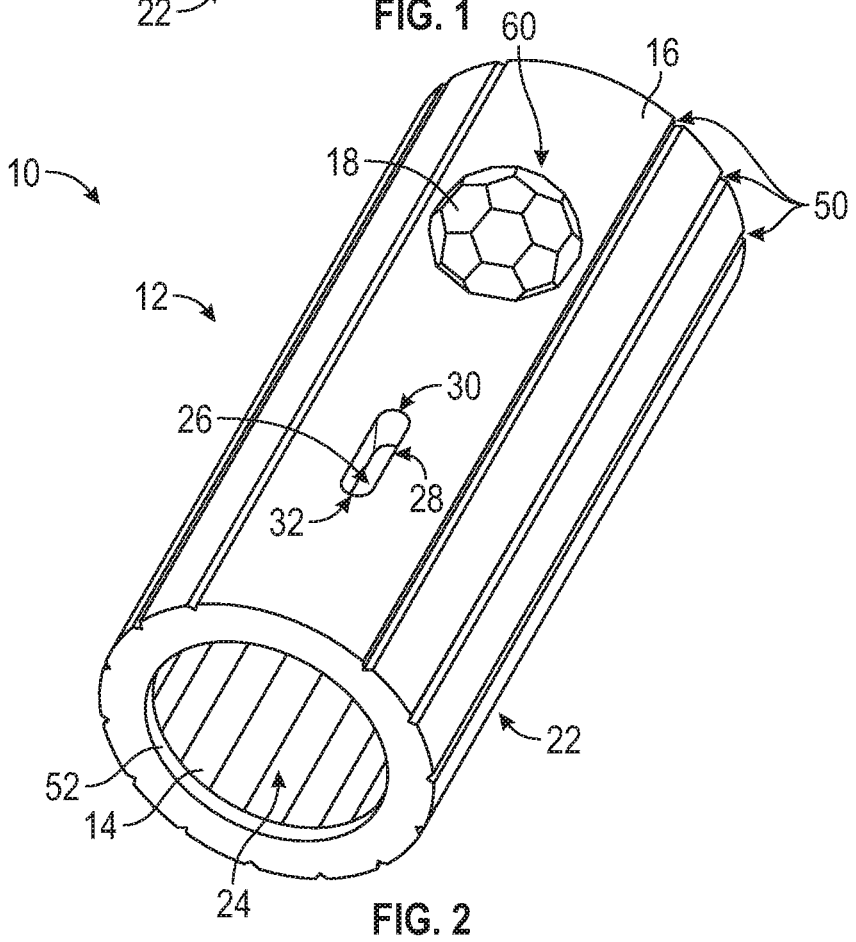
FIG. 2 is a second perspective view of the embodiment of the therapeutic roller shown in FIG. 1, including one coupling nodule.

As illustrated in FIG. 2, the hollow roller 12 includes a receptor opening 26 traversing the outer wall 22. FIG. 2 shows the embodiment of FIG. 1, with one of the coupling nodules 18 removed such that the receptor opening 26 is visible. The receptor opening 26 is configured to receive at least a portion of the coupling nodule 18 so as to secure the coupling nodule 18 to the hollow roller 12. The receptor opening 26 is also configured to release the coupling nodule 18 when the coupling nodule 18 is not in use. Thus, the user may utilize various coupling nodules 18 by emplacing the various coupling nodules 18 through the receptor opening 26 and selectively securing the various coupling nodules 18 thereto.

In embodiments of the invention, one or more receptor openings 26 are disposed in the outer wall 22. In the embodiments shown in FIGS. 1-3 and 6, two receptor openings 26 are disposed in the outer wall 22. The receptor openings 26 are spaced apart and aligned axially relative to the other. This allows the user to selectively utilize one or two coupling nodules 18, as discussed in more depth below. In the embodiments shown in FIGS. 4-5, four receptor openings 26 are disposed in the outer wall 22. The receptor openings 26 are spaced apart in a generally rectangular shape. The number of receptor openings 26 may be minimized for ease of manufacturing or increased for additional flexibility for the user. The number of receptor openings 26 used may be one, two, three, four, five, six, less than ten, more than ten, or some other number.

In some embodiments, the receptor opening 26 presents an elongated shape associated with an elongation axis. The elongated shape is configured to interface with the coupling nodule 18, as discussed in depth below. As illustrated in FIG. 2, the elongated shape may be a linear shape 28 with a first arcuate end 30 and a second arcuate end 32 (with the elongation axis being disposed along a line between the first arcuate end 30 and the second arcuate end 32). In other embodiments, not illustrated, the elongated shape presents another shape. For example, the elongated shape may present an ellipse, a rectangle, a diamond shape, or other shape that includes an elongation axis. The elongation axis is an axis of the elongated shape that is longer than another axis thereon. In some embodiments, one or more elongation axes may extend radially from a center of the receptor opening 26. In other embodiments, the receptor opening 26 presents another shape. For example, the receptor opening 26 may be a triangle, a plus-sign shape, a square shape, or some irregular shape.

Figure 3:
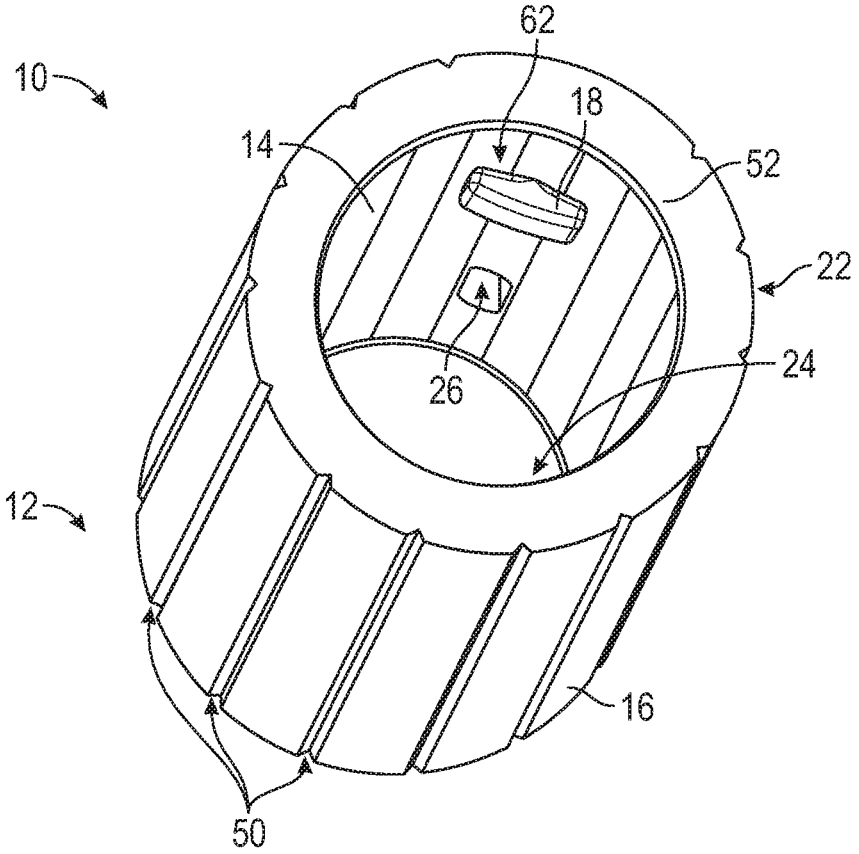
FIG. 3 is a third perspective view of the embodiment of the therapeutic roller shown in FIG. 1, illustrating how the coupling nodule is secured.
Figure 4:
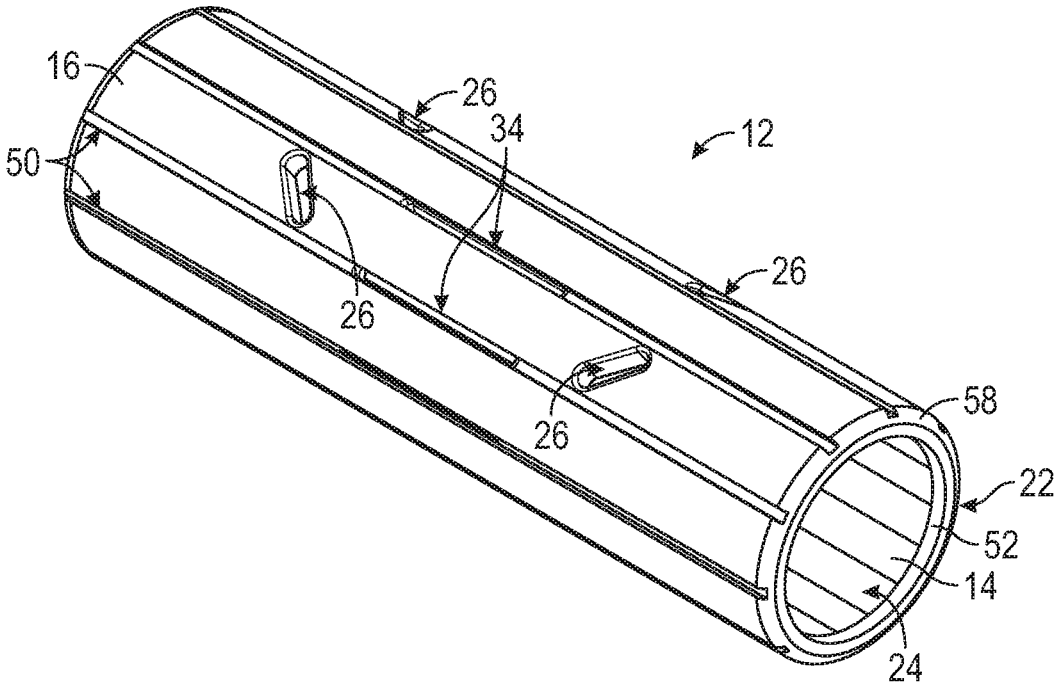
FIG. 4 is a perspective view of a second embodiment of the therapeutic roller.
Figure 5:
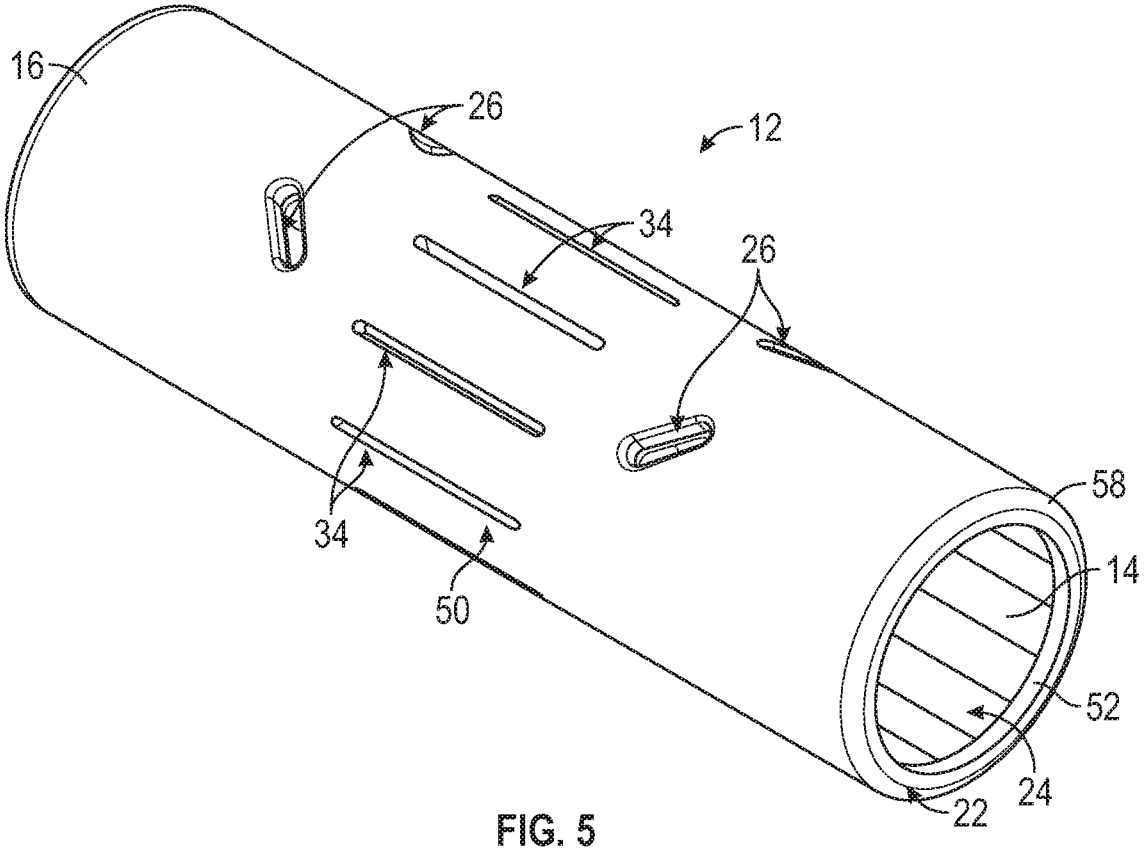
FIG. 5 is a perspective view of a third embodiment of the therapeutic roller.

In embodiments of the invention, such as illustrated in FIG. 3, the elongation axis is aligned with an axial direction of the hollow roller 12. The axial direction is the direction of the height of the hollow roller 12. The alignment of the elongation axis with the axial direction allows coupling nodule 18 to lock therein by turning a portion thereof perpendicular to the axial direction. FIG. 3 shows the coupling nodule 18 secured to the receptor opening 26, as discussed further below. In other embodiments, such as illustrated in FIGS. 4 and 5, the elongation axis is not aligned with the axial direction. In these embodiments, the elongation axis of the receptor openings 26 is at an angle in relation to the axial direction.

Figure 6:
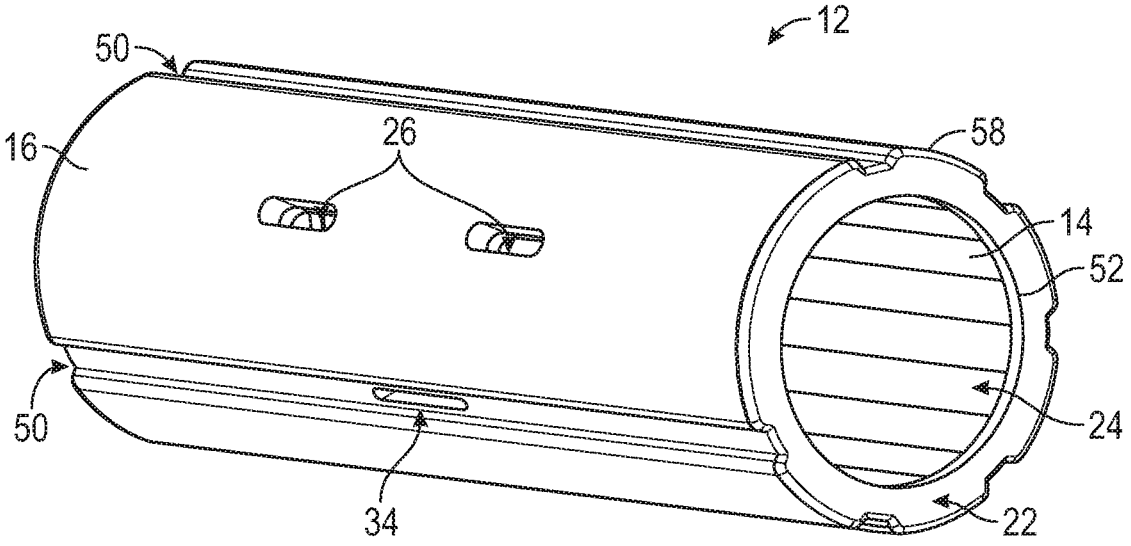
FIG. 6 is a perspective view of a fourth embodiment of the therapeutic roller.

In embodiments of the invention, the hollow roller 12 may also present secondary openings 34. The secondary openings 34 may traverse the inner core 14 and/or the outer core 16. The secondary openings 34 may be decorative, provide for expansion of the compressive outer core 16, or provide other functions. Examples of the secondary openings 34 are shown in FIGS. 4-6.

In embodiments of the invention, as illustrated in FIGS. 1 and 2, the outer wall 22 of the hollow roller 12 comprises the inner core 14 and the outer core 16. In embodiments, the inner core 14 is a rigid inner core 14 and the outer core 16 is a compressive outer core 16. Generally, the rigid inner core 14 provides structural stability to the hollow roller 12. The compressive outer core 16 provides a surface conducive for compression thereof by a body part of the user. The compressive outer core 16 compresses in response to an exterior force, such as a pressing thereon by a user.

In embodiments of the invention, the rigid inner core 14 is permanently secured to the compressive outer core 16. In some embodiments, the compressive outer core 16 is formed around the rigid inner core 14. In other embodiments, the compressive outer core 16 is manufactured independently and then placed around the rigid inner core 14. The rigid core may be held securely against the compressive outer core 16 through mechanical compression of the compressive outer core 16, a chemical adhesive, or other securing structure.

Figure 7:
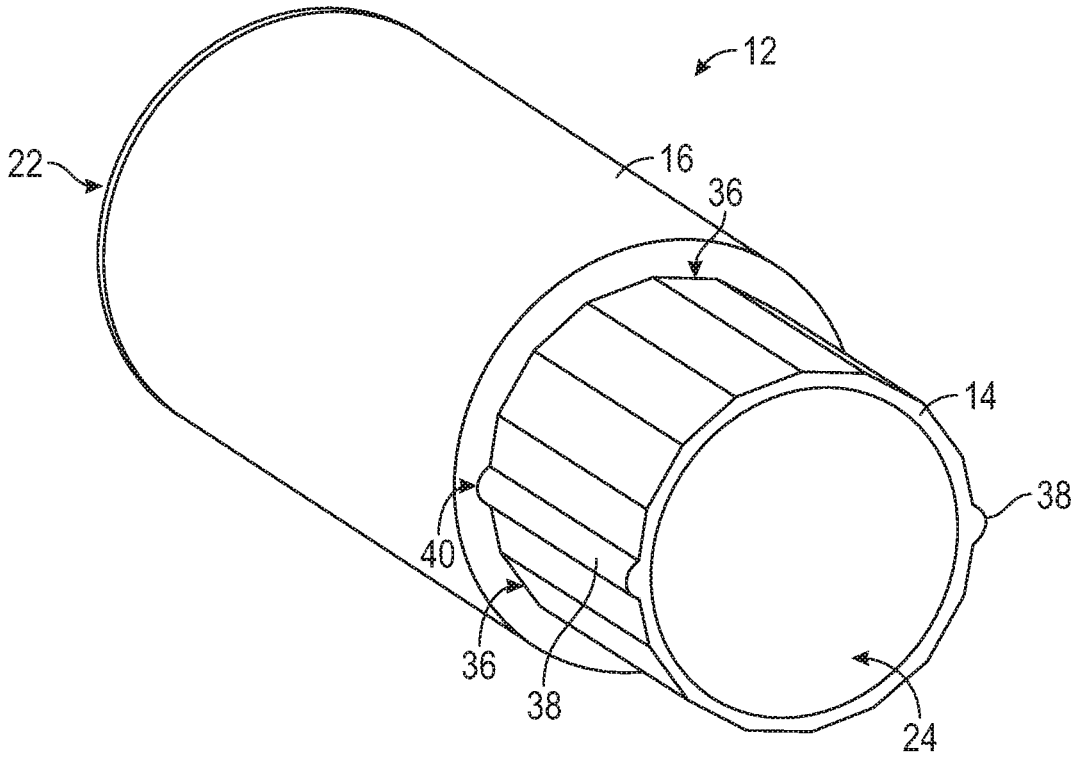
FIG. 7 is a perspective cutaway view showing an inner core and an outer core of the therapeutic roller.

As best illustrated in FIG. 7, the compressive outer core 16 contacts the rigid inner core 14 at an intra-wall interface 36. The intra-wall interface 36 is the complementary shape of the inner core 14 and/or the outer core 16, as best illustrated in FIG. 7. The intra-wall interface 36 prevents or reduces slipping of the inner core 14 relative to the outer core 16. Because the receptor opening 26 traverses both the inner core 14 and the outer core 16, the alignment of the inner core 14 and the outer core 16 should be maintained. In some embodiments, this alignment is maintained through a chemical adhesive. It should be appreciated that FIG. 7 illustrates a hollow roller 12 with a portion of the outer core 16 removed so as to make the intra-wall interface visible.

In embodiments, this alignment is maintained by complementary structures on the inner core 14 and the outer core 16, such as illustrated in FIG. 7. In embodiments of the invention the rigid inner core 14 comprises an alignment ridge 38 and the compressive outer core 16 comprises an alignment recess 40. The alignment ridge 38 protrudes radially from at least one portion of the inner core 14 and is elongated in the axial direction. The alignment recess 40 of the outer core 16 is complementary so as to receive the alignment ridge 38 and resist movement of the inner core 14 relative to the outer core 16. In other embodiments, the alignment ridge 38 may be disposed on the outer core 16 and the alignment recess 40 may be disposed on the inner core 14. In still other embodiments, other complementary structures may be disposed on the inner core 14 and the outer core 16 to prevent the movement of the inner core 14 relative to the outer core 16.

Figure 8:
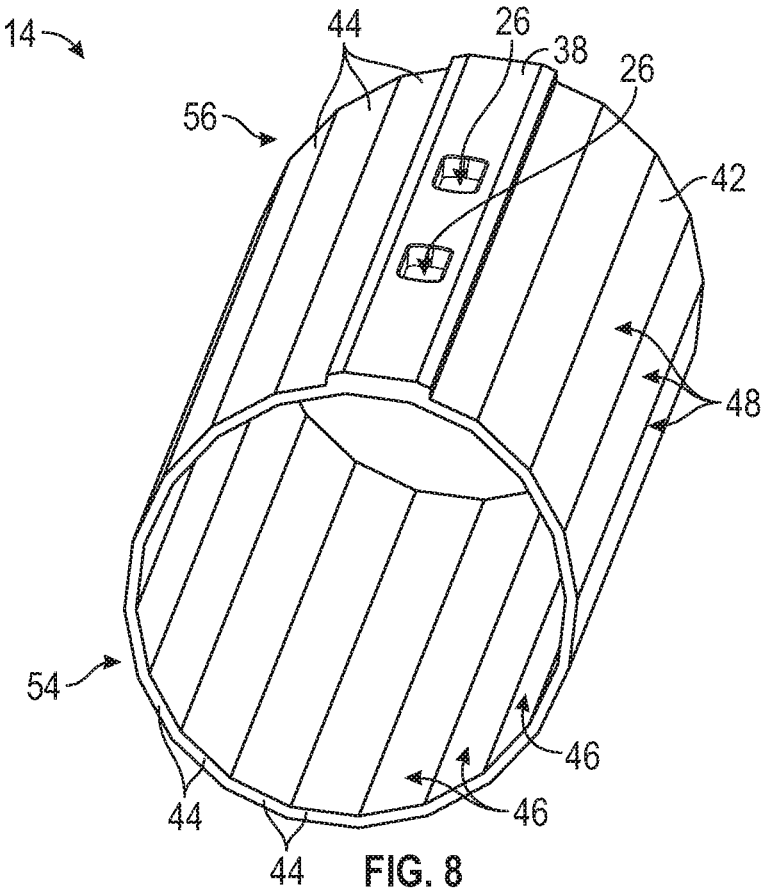
FIG. 8 is a perspective view showing another embodiment of the inner core.

In some embodiments, such as shown in FIG. 8, the alignment ridge 38 may present one or more receptor openings 26 therein. As can be seen, the receptor openings 26 being disposed within the alignment ridge 38 may provide additional thickness to the receptor opening 26 to provide additional structural stability to the receptor opening 26. The receptor opening 26 being disposed on the alignment ridge 38 may additionally provide a higher proportion of the length of the receptor opening 26 as the resilient inner core 14 as opposed to the more easily damaged outer core 16.

In embodiments of the invention, the rigid inner core 14 includes a multi-faceted wall 42, as best illustrated in FIG. 8. The multi-faceted wall 42 may provide additional structural stability compared to a smooth wall. The multi-faceted wall 42 may also provide properties to reduce movement of the inner core 14 relative to the outer core 16 (similar to the alignment ridge 38 of some embodiments, discussed above). Further, the multi-faceted wall 42 may provide a suitable surface for securing the coupling nodule 18 thereto (as illustrated in FIG. 3 and discussed more below). For example, the multi-faceted wall 42 may provide an angled inner surface relative to the receptor opening 26, such that the coupling nodule 18 may be secured thereto by rotation. In embodiments, facets 44 are disposed in the axial direction. In some embodiments, the multi-faceted wall 42 may present twenty facets 44 (as illustrated in FIG. 8), eighteen facets 44, twenty-two facets 44, at least ten facets 44, at least twenty facets 44, or some other number of facets 44.

In some embodiments, the multi-faceted may present a plurality of internal facets 46 and a plurality of external facets 48, as illustrated in FIG. 8. In other embodiments, the multi-faceted wall 42 may present a plurality of external facets 48 and a smooth inner wall, as illustrated in FIG. 7. In still other embodiments, the multi-faceted wall 42 may present a plurality of internal facets 46 and a smooth outer wall 22, not illustrated. In some embodiments, the number of external facets 48 may be different than the number of internal facets 46.

The compressive outer core 16 is formed of a material configured to myofascial release or other therapeutic purpose, such as a thermoplastic elastomer or other polymer. The compressive outer core 16 is elastic, such that it returns to its original shape once an external force is removed, such as an EVA plastic, an ABS plastic, or other polymer. The compressive outer core 16 is supported by the rigid inner core 14 such that the external forces placed on the compressive outer core 16 do not cause a buckling of the compressive outer core 16.

In embodiments of the invention, the compressive outer core 16 presents a plurality of external channels 50 along an axial direction. The external channels 50 provide a reduced rolling of the hollow roller 12. Because in the exemplary usage described above, the user is not rolling the hollow roller 12 a long distance (which would be difficult with the coupling nodules 18 secured thereto), the external channels 50 reduce this rolling tendency. In some embodiments, the external channels 50 may interface with the non-coupling nodule 20 to allow increased frictional hold between the hollow roller 12 and the coupling nodule 18.

In some embodiments, the external channels 50 may present a general V-shape about a cross-section, as can be seen in FIG. 1-3. In other embodiments, the external channels 50 may present a general square or rectangular shape about a cross-section, as can be seen in FIG. 4. In still other embodiments, the external channels 50 may not extend for the entire length of the hollow roller 12 (and thus may be considered secondary openings 34), as can be seen in FIG. 5. In yet still other embodiments, the external channel may present a general trapezoid shape about a cross-section, as can be seen in FIG. 6. In yet other embodiments, the compressive outer core 16 may not present any external channels 50, as can be seen in FIG. 7. Other embodiments of the invention may utilize other external channel shapes, such as a general U-Shape, an arcuate shape, or other shape (not illustrated).

In embodiments of the invention, the compressive outer core 16 comprises a radially-inward protrusion 52, as illustrated in FIGS. 1-6. The radially-inward protrusion 52 prevents axial movement of the inner core 14 relative to the outer core 16. Thus, the radially-inward protrusion 52 at least partially keeps the receptor opening 26 aligned between the inner core 14 and the outer core 16. The radially-inward protrusion 52 may also prevent damage to the rigid inner core 14. The radially-inward protrusion 52 may also prevent injury to the user that may strike the inner core 14 with a body part.

The radially-inward protrusion 52 presents an annular shape that is at least partially the same size as the inner core 14. Thus, the radially-inward protrusion 52 covers the respective ends of the inner core 14. More specifically, the rigid inner core 14 presents a first end 54 and a second end 56 (as illustrated in FIG. 8). The compressive outer core 16 includes a first radially-inward protrusion 52 that covers at least a portion of the first end 54 of the rigid inner core 14. The compressive outer core 16 also includes a second radially-inward protrusion 52 that covers at least a portion of the second end 56 of the rigid inner core 14. In embodiments, the inner core 14 is secured to the outer core 16 by compressing the first radially-inward protrusion 52, sliding the inner core 14 into the outer core 16, and releasing the first radially-inward protrusion 52. In other embodiments, the compressive outer core 16 may not present the radially-inward protrusion 52. In these embodiments, the rigid inner core 14 may present an exposed edge (not illustrated) visible and accessible from the first end 54 and/or the second end 56.

In some embodiments, such as illustrated in FIGS. 4-6, the compressive outer core 16 may include one or more beveled ends 58. The beveled ends 58 may reduce the impact of dropping the hollow roller 12, increase the comfort for users pressing a body part against an end, or provide other benefit. The beveled ends 58 may be arcuate, chamfered, or another shape.

The coupling nodule 18 will now be discussed in more detail. As discussed above, the coupling nodule 18 is configured to be selectively added to and removed from the hollow roller 12. The coupling nodule 18 may be selected based upon a certain size, shape, hardness, or other attribute. Once selected, the coupling nodule 18 is inserted into the hollow roller 12, secured thereto, and then utilized for myofascial release (or other process). FIG. 1 illustrates two coupling nodules 18 secured to the hollow roller 12. FIGS. 2 and 3 illustrate a single coupling nodule 18 secured to the hollow roller 12. FIGS. 9-13 illustrate exemplary coupling nodules 18 that may be utilized. It should be appreciated that, like with the other figures, the provided figures are only exemplary. Coupling nodules 18 may utilize other shape, sizes, attachments, and other structures.

In embodiments of the invention, the coupling nodule 18 comprises an upper therapeutic segment 60 and a lower locking segment 62. The upper therapeutic segment 60 is configured to provide myofascial release of a body part pressed thereon by a user. The lower locking segment 62 is configured to selectively secure the coupling nodule 18 to the hollow roller 12. As used herein, "upper" refers to radially outward when installed in the hollow roller 12, and "lower" refers to radially inward when installed in the hollow roller 12. Thus, when installed the upper therapeutic segment 60 of the coupling nodule 18 extends radially from the hollow roller 12 and the lower locking segment 62 is inserted radially into the hollow roller 12 (specifically, at the receptor opening 26 discussed above). The upper therapeutic segment 60 of the coupling nodule 18 is configured to extend radially from the hollow roller 12 while the lower locking segment 62 is secured within the receptor opening 26.

In embodiments of the invention, the coupling nodule 18 presents a general mushroom shape, as illustrated in FIGS.

9-13. At least a portion of the upper therapeutic segment 60 presents a larger cross-sectional area than the lower locking segment 62 so that the lower locking segment 62 can secure the upper therapeutic segment 60 against an outer surface of the compressive outer core 16. Thus, the coupling nodule 18 presents an axial direction aligned generally upward from the view of FIG. 9. In other embodiments, the coupling nodule 18 presents another shape.

In embodiments of the invention, the lower locking segment 62 is configured to be inserted into the receptor opening 26 in a first orientation and secured within the receptor opening 26 in a second orientation. The first orientation and the second orientation are relative to the hollow roller 12. The user inserts the lower locking segment 62 into the receptor opening 26 while holding the lower locking segment 62 in the first orientation. Once inserted, the user rotates, spins, pivots, or otherwise changes the orientation of the lower locking segment 62 into the second orientation. While in the second orientation, the lower locking segment 62 is held against the hollow roller 12, as best illustrated in FIG. 3. It should be appreciated that the "first orientation" and the "second orientation" may include or be a lateral change in position. For example, the user may insert the lower locking segment 62 into the receptor opening 26 and then slide the lower locking segment 62 parallel to the outer wall 22 to a second position that will hold the lower locking segment 62.

In embodiments of the invention, the lower locking segment 62 comprises a traversing post 64 and a locking protrusion 66. The traversing post 64 is configured to be disposed within the receptor opening 26 while the coupling nodule 18 is secured to the hollow roller 12. The locking protrusion 66 extends radially from the traversing post 64 to provide the locking functionality. Thus, the locking protrusion 66 is disposed at a different position relative to the hollow roller 12 in the second orientation compared to the first orientation. By rotating the coupling nodule 18 between the first orientation and the second orientation, the user is changing the location of the locking protrusion 66 and thus selectively securing and un-securing the locking protrusion 66 from the hollow roller 12.

The traversing post 64 that extends axially from the upper therapeutic segment 60. In embodiments of the invention, the traversing post 64 presents a cylindrical shape such that the traversing post 64 can change between the first orientation and the second orientation without affecting the interface with the hollow roller 12. The cylindrical shape allows an outer wall 68 (illustrated in FIGS. 9 and 10) the traversing post 64 to remain in contact with or adjacent to the receptor opening 26 regardless of the orientation of the coupling nodule 18 relative to the hollow roller 12.

Figure 9:
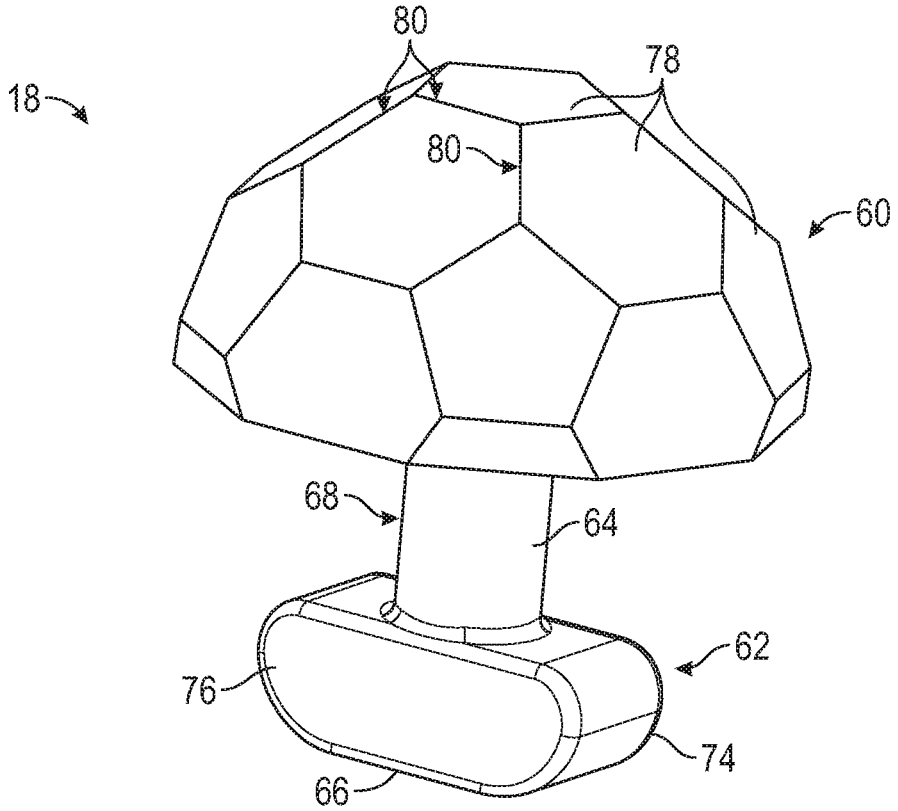
FIG. 9 is a perspective view of a first embodiment of the coupling nodule.
Figure 10:
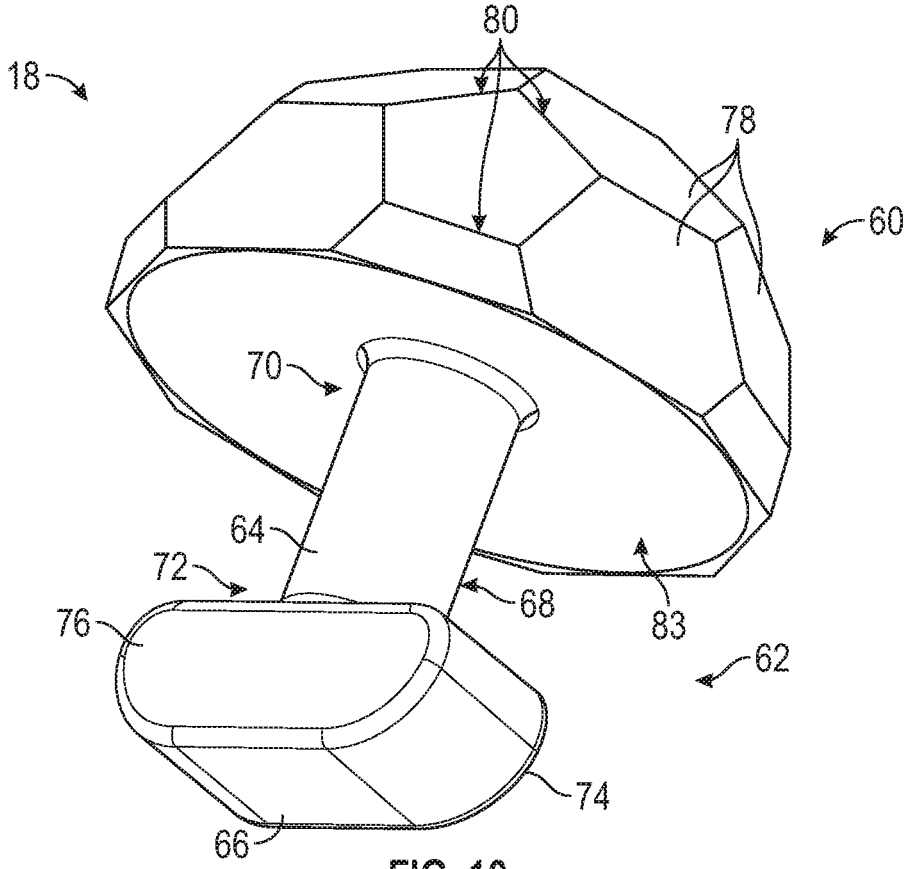
FIG. 10 is a second perspective view of the coupling nodule of FIG. 9.
Figure 11:
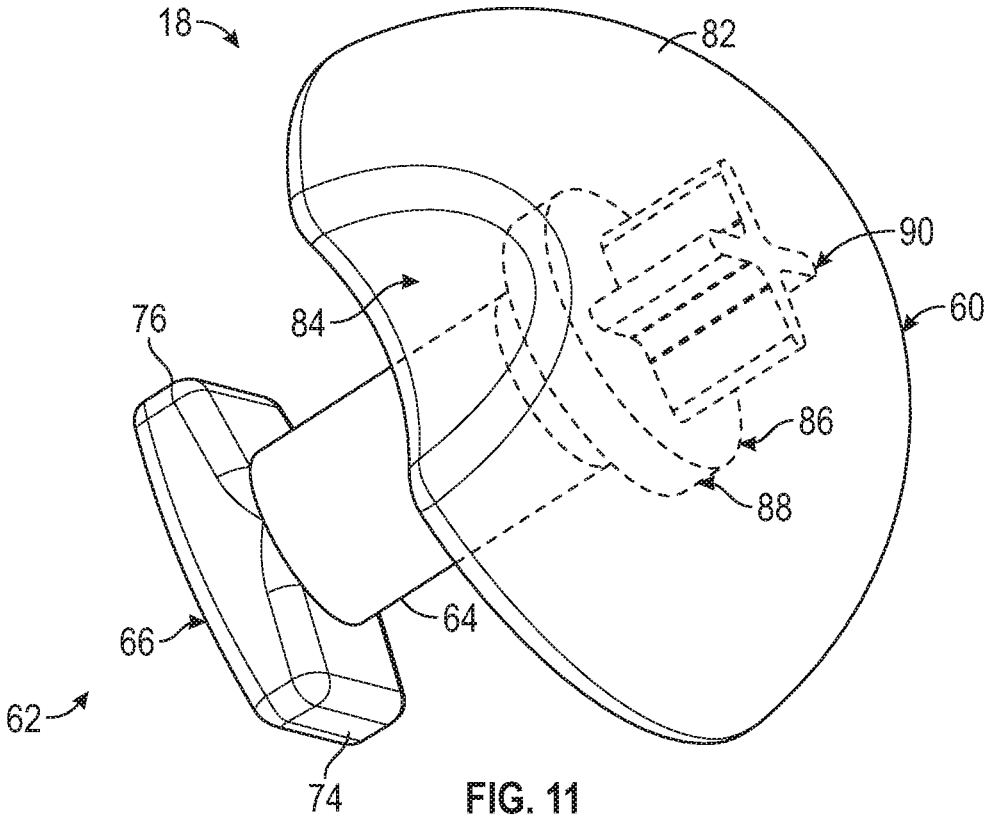
FIG. 11 is a perspective view of a second embodiment of the coupling nodule.
Figure 12:
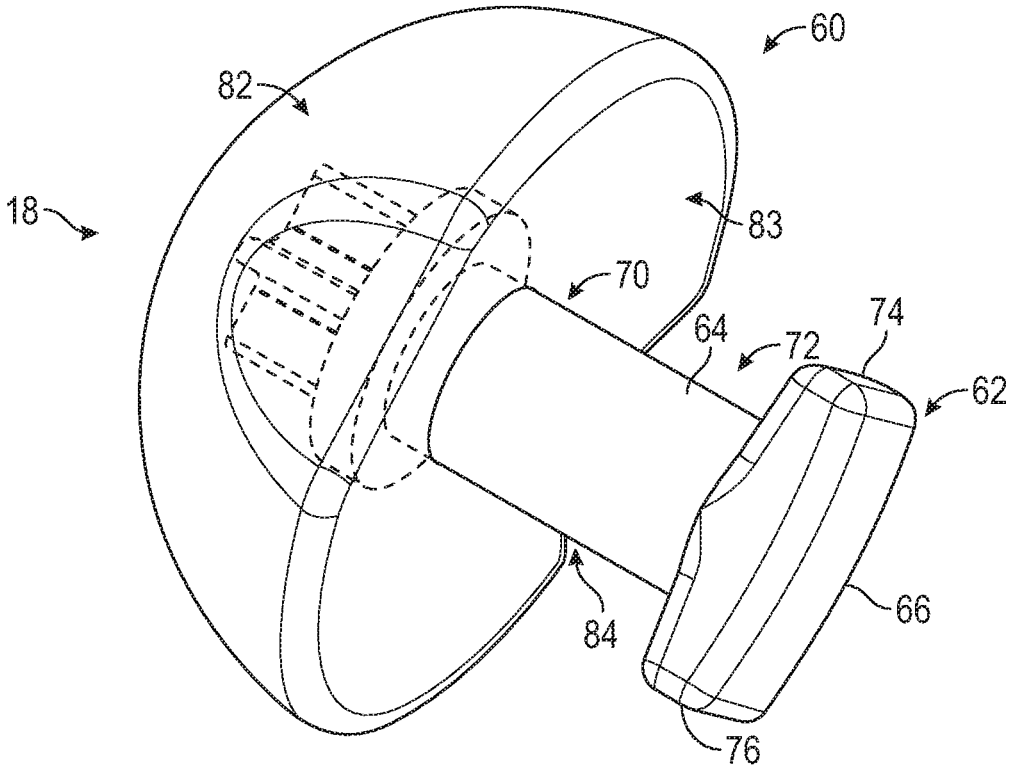
FIG. 12 is a second perspective view of the coupling nodule of FIG. 11.

The traversing post 64 presents a proximal end 70 adjacent to the upper therapeutic segment 60 and a distal end 72 opposite the proximal end 70 (as illustrated in FIGS. 10 and 12). The traversing post 64 extends downward from the upper therapeutic segment 60. The locking protrusion 66 extends radially the distal end 72 of the traversing post 64. In the embodiments shown in FIGS. 9-13, the locking protrusion 66 includes a first protrusion 74 extending radially from the traversing post 64 in a first direction and a second protrusion 76 extending radially from the traversing post 64 in a second direction opposite the first direction. In other embodiments, the locking protrusion 66 may comprise only a first protrusion 74 extending radially from the traversing post 64 in a first direction. In still other embodiments, the locking protrusion 66 may comprise a first protrusion 74 in a first direction and a second protrusion 76 in a second direction that is not opposite the first direction (such as at a ninety-degree angle or other angle relative to the first direction). In yet other embodiments, the locking protrusion 66 may include three or more protrusions extending radially in a corresponding three or more directions (such as at a one-hundred-and-twenty-degree angle relative to the others, or other angle).

As discussed above, in some embodiments, the receptor opening 26 presents an elongated shape associated with an elongation axis. The locking protrusion 66 presents a complementary shape to the elongated shape of the receptor opening 26. The elongation axis of the receptor opening 26 is best seen in FIG. 2. In the first orientation, at least a portion of the lower locking segment 62 is aligned with the elongation axis. For example, the locking protrusion 66 would be aligned with the elongation axis of the receptor opening 26. This would allow the locking protrusion 66 to pass through the receptor opening 26. In the second orientation, at least a portion of the lower locking segment 62 is perpendicular to the elongation axis, as best seen in FIG. 3. As discussed above, in some embodiments, the elongation axis is aligned with an axial direction of the hollow roller 12 (as shown in FIGS. 2-3 and 6) or at an angle relative to the axial direction of the hollow roller 12 (as shown in FIGS. 4 and 5). In embodiments in which more or fewer protrusions are utilized, the receptor opening 26 may present another shape configured to accommodate the lower locking segment 62 traversing the receptor opening 26 in the first orientation and securing the lower locking segment 62 to the hollow roller 12 in the second orientation.

The upper therapeutic segment 60 of the coupling nodule 18 is configured to extend radially from the hollow roller 12 while the lower locking segment 62 is secured within the receptor opening 26, as illustrated in FIGS. 1 and 2. The upper therapeutic segment 60 is configured to provide myofascial release of a body part pressed thereon by a user. Because the upper therapeutic segment 60 extends radially from the hollow roller 12, the upper therapeutic segment 60 allows the user to perform an isolation massage on a certain area of a muscle or other body part. In some embodiments, the user may utilize both the compressive outer core 16 and the upper therapeutic segment 60 for myofascial release.

Figure 13:
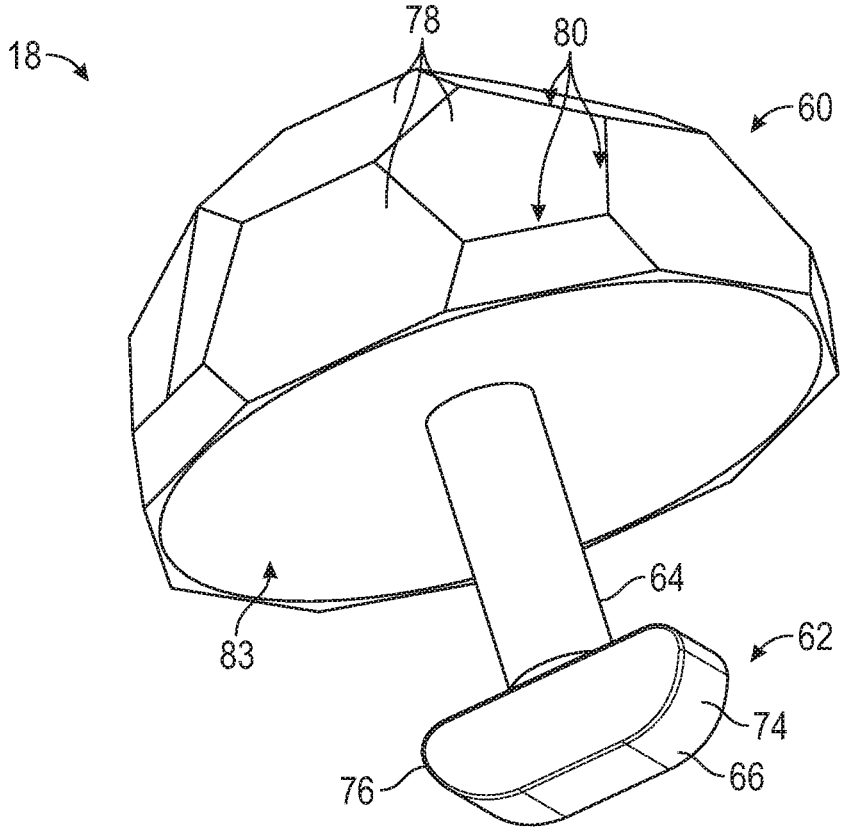
FIG. 13 is a perspective view of a third embodiment of the coupling nodule.
Figure 14:
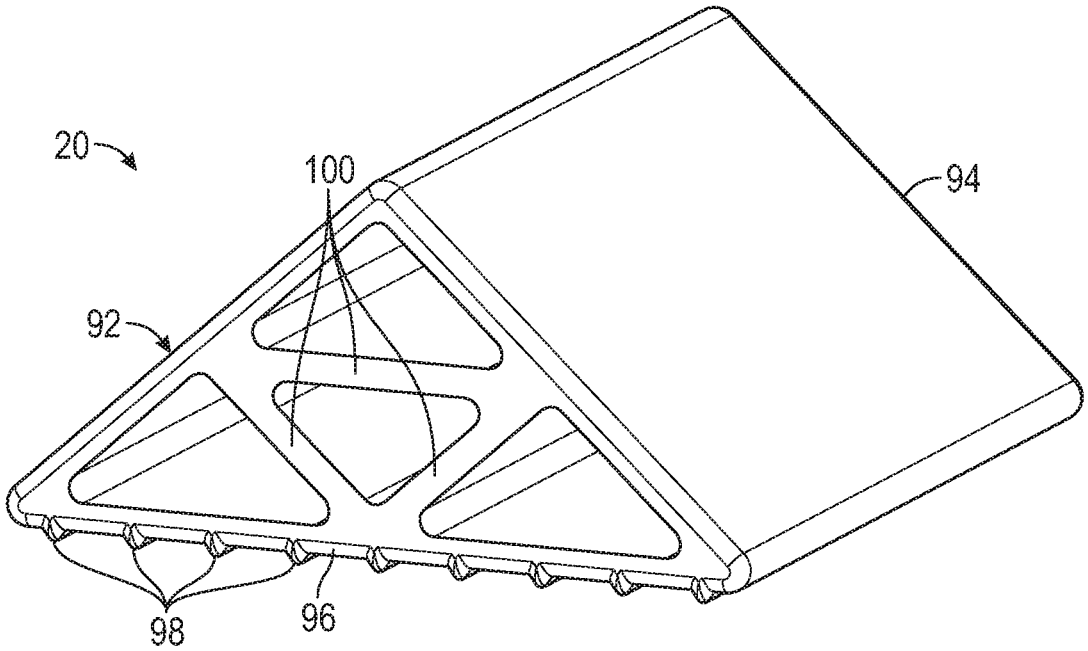
FIG. 14 is a perspective view of a non-coupling nodule.
Figure 15:
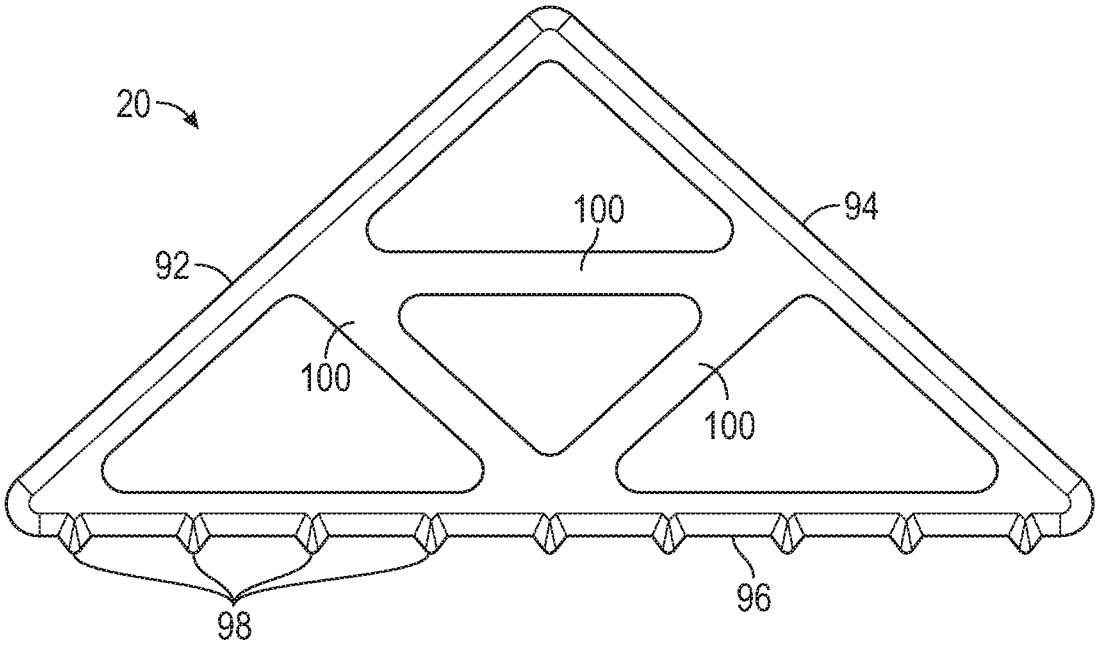
FIG. 15 is an end view of the non-coupling nodule of FIG. 14.

In embodiments of the invention, such as illustrated in FIGS. 9-10 and 13, the upper therapeutic segment 60 presents a geodesic shape. The geodesic shape provides flat segments 78 with ridge segments 80 surrounding the flat segments 78. The geodesic shape thus provides the user with precise areas for myofascial release. The user may press, push, or pull a muscle against a ridge segment or a flat segment to perform a certain function. The geodesic shape provides these flat segments 78 and ridge segments 80 at multiple locations relative to the hollow roller 12, thus providing the user with flexibility as to how to utilize the upper therapeutic segment 60.

The flat segments may present any of numerous shapes, such as hexagons, pentagons, and other shapes. In some embodiments of the invention, the number of flat segments 78 and ridge segments 80 may be selected to provide an overall shape of the upper therapeutic segments. More flat segments 78 and ridge segments 80 provide a more arcuate overall shape and fewer flat segments 78 and ridge segments 80 provide a more angular overall shape. In some embodiments of the invention, the therapeutic roller system 10 may include a first coupling nodule 18 with fewer flat segments 78 and ridge segments 80 and a second coupling nodule 18 with more flat segments 78 and ridge segments 80, such that the user can select a desired overall shape of the therapeutic segment.

In other embodiments, such as illustrated in FIGS. 11 and 12, the upper therapeutic segment 60 presents an arcuate shape. The arcuate shape provides a rounded surface 82 against which the user can perform myofascial release (or other function). In still other embodiments, not illustrated, the upper therapeutic segment 60 may present another shape, such as a hemisphere, a cylinder, a cone, a cube, a saddle, a semi-dodecahedron, a semi-icosahedron, a semi-octahedron, a torus, an ellipsoid, a tetrahedron, a square pyramid, a pentagonal pyramid, a hexagonal pyramid, an octagonal pyramid, a triangular prism, a quadrilateral prism, a pentagonal prism, a hexagonal prism, an octagonal prism, or an irregular shape. In some embodiments, the upper therapeutic segment 60 presents a shape configured specifically for a certain muscle or other body part.

In embodiments of the invention, the upper therapeutic segment 60 presents a roller-interface surface 83, as illustrated in FIGS. 10 and 12-13. The roller-interface surface 83 aligns with the outer wall 22 of the hollow roller 12. In various embodiments, the roller-interface surface 83 may be concave, convex, or flat. For example, the roller-interface surface 83 may be concave such that radially-outward segments of the roller-interface surface 83 may flex or compress to conform with the outer wall 22 of the hollow roller 12.

The upper therapeutic segment 60 may also be provided in multiple sizes. For example, the upper therapeutic segment 60 illustrated in FIG. 13 is larger than the upper therapeutic segment 60 illustrated in FIGS. 9-10, while the lower locking segment 62 is the same size. In this way, the user can select the size of the upper therapeutic segment 60 based upon the user's body size, the size of the muscle, the type of motion to be used, or other factors.

The upper therapeutic segment 60 may also present one or more gripping recesses 84, as shown in FIGS. 11 and 12. The gripping recesses 84 are configured to receive a finger and/or thumb of the user to facilitate the user rotating the upper therapeutic segment 60 (and by extension rotating the lower locking segment 62 so as to secure or release the lower locking component). The gripping recesses 84 are into the above-discussed shape of the upper therapeutic segment 60. In some embodiments, the geodesic shape may not be provided with gripping recesses 84 as the user can adequately grip the geodesic shape.

In embodiments of the invention, not illustrated, the therapeutic roller system 10 may include a traversing coupling nodule that is configured to be simultaneously secured to two or more receptor openings 26. In these embodiments, the upper therapeutic segment 60 will span between two or more receptor openings 26. In these embodiments, the lower locking segment 62 may be independently rotatable such that the user can change the orientation of the lower locking segment 62 relative to the hollow roller 12 while maintaining the upper therapeutic segment 60 between the two or more receptor openings 26.

In some embodiments, the coupling nodule 18 is formed of a unitary or monolithic construction. In these embodiments, the coupling nodule 18 is formed of the same material and both the upper therapeutic segment 60 and the lower locking segment 62 are formed together.

In other embodiments, the coupling nodule 18 is formed of a separate construction. In these embodiments, such as illustrated in FIGS. 11 and 12, the lower locking segment 62 may be at least partially formed of a rigid material (such as the material which forms the rigid inner core 14) and the upper therapeutic segment 60 may be at least partially formed of a compressive material (such as the material which forms the compressive outer core 16). As an example, the lower locking segment 62 may be formed of an ABS plastic and the upper therapeutic segment 60 may be formed of a thermoplastic elastomer. The lower locking segment 62 may present an intra-nodule protrusion 86 so as to secure the lower locking segment 62 within the upper therapeutic segment 60. The intra-nodule protrusion 86 may include a radial protrusion 88 and an axial protrusion 90. The radial protrusion 88 and/or the axial protrusion 90 may be at least partially contained within the upper therapeutic segment 60.

In embodiments of the invention, the coupling nodule 18 is configured to provide another therapeutic benefit. For example, in some embodiments, the coupling nodule 18 is configured to be heated and/or cooled to provide other therapeutic benefits. The coupling nodule 18 may be at least partially formed of a material configured to retain the cooling or heating. The coupling nodule 18 may have a heating pack or a cooling pack therein. In other embodiments, the coupling nodule 18 may include a mechanical vibrator to provide vibration to the user's muscle or other body part.

The non-coupling nodule 20 is configured to be disposed against the hollow roller 12 without directly coupling or securing to the hollow roller 12. The non-coupling nodule 20 may be configured for any of various purposes. In some embodiments, the non-coupling nodule 20 is configured to prevent a rolling of the hollow roller 12. The non-coupling nodule 20 of these embodiments may present a general triangular prism shape and comprise a first roller interface side 92, a second roller interface side 94, and an underlying surface interface side 96. One or more of the sides 92, 94, 96 may present tread protrusions 98 configured to reduce slipping of the hollow roller 12 relative to the non-coupling nodule 20 and/or the non-coupling nodule 20 relative to the underlying surface. The non-coupling nodule 20 may further comprise strut plates 100 extending between one or more of the sides 92, 94, 96.

Figure 16:
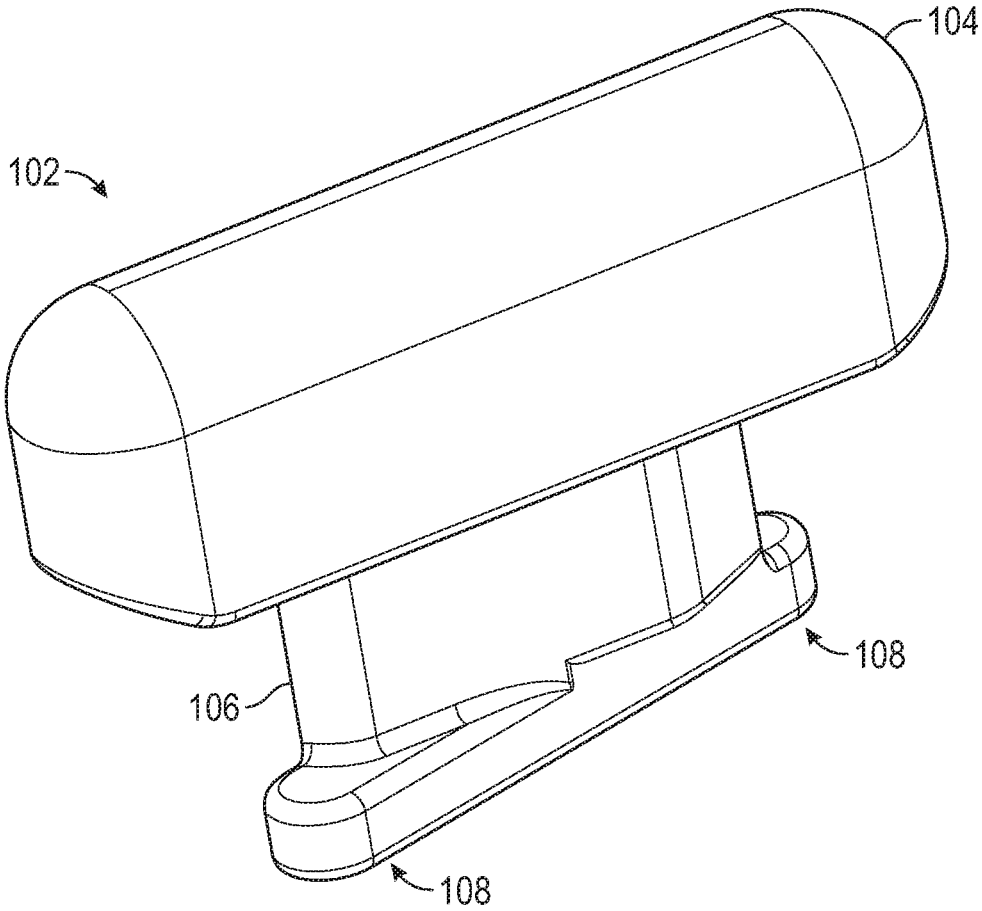
FIG. 16 is a perspective view of a kickstand coupling nodule.

In still other embodiments, as illustrated in FIG. 16, the therapeutic roller system 10 further includes a kickstand coupling nodule 102. The kickstand coupling nodule 102 performs the same functions as the above-discussed non-coupling nodule 20 while coupled to the hollow roller 12. More specifically, the kickstand coupling nodule 102 prevents the hollow roller 12 from rolling. The kickstand coupling nodule 120 may therefore be inserted into a receptor opening 26 that is opposite from or on another side relative to the receptor opening 26 into which the coupling nodule 18 is inserted. As illustrated in FIG. 16, the kickstand coupling nodule may include a kickstand protrusion segment 104, which protrudes from the hollow roller 12, and a kickstand locking segment 106, which is configured to be secured to the hollow roller 12. The kickstand locking segment 106 may include one or more locking protrusions 108.

In other embodiments, the non-coupling nodule 20 is configured to secure at least a portion of the therapeutic roller system 10 for carrying. In still other embodiments, the non-coupling nodule 20 is configured to hold the hollow roller 12 in a certain position while allowing the hollow roller 12 to pivot.

While various methods have been discussed herein, a method of myofascial release will now be discussed. In embodiments of the invention, the method generally comprises acquiring a therapeutic roller system 10 including a hollow roller 12 and a coupling nodule 18; inserting, in a first orientation, a lower locking segment 62 of the coupling nodule 18 into a receptor opening 26 of the hollow roller 12; rotating the lower locking segment 62 axially, to a second orientation, so as to secure the coupling nodule 18 to the hollow roller 12; placing the hollow roller 12 into a first position on a surface; pressing a body part against an upper therapeutic segment 60 of the coupling nodule 18 protruding radially from the hollow roller 12; and moving the body part relative to the upper therapeutic segment 60 to achieve myofascial release.

The method may further comprise selecting a coupling nodule 18 from a set of coupling nodules 18 based at least in part on the size and/or shape of a therapeutic segment of the coupling nodule 18. The method may further comprise placing a non-coupling nodule 20 on an underlying surface and placing the hollow roller 12 adjacent to the non-coupling nodule 20, that is in the above-discussed first position. The user will then press against the coupling nodule 18 such that the non-coupling nodule 20 keeps the hollow roller 12 in the first position.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

What is claimed is:

1. A therapeutic roller system comprising:
a hollow roller presenting an outer wall,
wherein the hollow roller includes a receptor opening traversing the outer wall,
wherein the receptor opening is elongated to present an elongated axis; and
a coupling nodule including:
an upper therapeutic segment;
a traversing post that extends axially from the upper therapeutic segment,
wherein the traversing post is laterally adjustable along the elongated axis of the receptor opening for therapeutic positioning; and
a lower locking segment mechanically coupled to the traversing post,
wherein the lower locking segment is configured to be inserted into the receptor opening in a first orientation,
wherein the lower locking segment is configured to be secured within the receptor opening in a second orientation.

2. The therapeutic roller system of claim 1, wherein the outer wall of the hollow roller comprises:
a rigid inner core; and
a compressive outer core,
wherein the receptor opening traverses both the rigid inner core and the compressive outer core.

3. The therapeutic roller system of claim 2, wherein the rigid inner core presents a plurality of facets along an axial direction.

4. The therapeutic roller system of claim 2, wherein the compressive outer core presents a plurality of external channels along an axial direction.

5. The therapeutic roller system of claim 2,
wherein the rigid inner core presents a first end and a second end,
wherein the compressive outer core includes a first radially-inward protrusion that covers at least a portion of the first end of the rigid inner core.

6. The therapeutic roller system of claim 1,
wherein, in the first orientation, at least a portion of the lower locking segment is aligned with the elongated axis.

7. The therapeutic roller system of claim 6, wherein, in the second orientation, at least a portion of the lower locking segment is perpendicular to the elongated axis.

8. The therapeutic roller system of claim 6, wherein the elongated axis is aligned with an axial direction of the hollow roller.

9. The therapeutic roller system of claim 1,
wherein the upper therapeutic segment of the coupling nodule is configured to extend radially from the hollow roller while the lower locking segment is secured within the receptor opening
wherein the upper therapeutic segment is configured to provide myofascial release of a body part pressed thereon by a user.

10. The therapeutic roller system of claim 1,
wherein the traversing post presents a proximal end adjacent to the upper therapeutic segment and a distal end opposite the proximal end,
a locking protrusion that extends radially from the distal end of the traversing post.

11. The therapeutic roller system of claim 1, further comprising:
a non-coupling nodule configured to be disposed against the hollow roller,
wherein the non-coupling nodule is configured to prevent a rolling of the hollow roller.

12. A coupling nodule configured to be secured to a receptor opening of a hollow roller, the coupling nodule comprising:
an upper therapeutic segment configured to provide myofascial release of a body part pressed thereon by a user;
a traversing post that extends axially from the upper therapeutic segment,
wherein the traversing post is laterally adjustable along an elongated axis of the receptor opening for therapeutic positioning; and
a lower locking segment mechanically coupled to the traversing post,
wherein the lower locking segment is configured to be inserted into the receptor opening in a first orientation,
wherein the lower locking segment is configured to be secured within the receptor opening in a second orientation.

13. The coupling nodule of claim 12, wherein the upper therapeutic segment of the coupling nodule is configured to extend radially from the hollow roller while the lower locking segment is secured within the receptor opening.

14. The coupling nodule of claim 12, wherein the upper therapeutic segment presents a geodesic shape.

15. The coupling nodule of claim 12,
wherein the traversing post presents a proximal end adjacent to the upper therapeutic segment and a distal end opposite the proximal end,
a locking protrusion that extends radially from the distal end of the traversing post.

16. The coupling nodule of claim 15,
wherein the locking protrusion is a first locking protrusion, wherein the lower locking segment further comprises a second locking protrusion extending radially from the distal end of the traversing post.

17. A method of myofascial release comprising:

acquiring a therapeutic roller system including a hollow roller and a coupling nodule;

inserting, in a first orientation, a lower locking segment of the coupling nodule into a receptor opening of the hollow roller;

adjusting the coupling nodule laterally along an elongated axis of the receptor opening for therapeutic positioning;

rotating the lower locking segment axially, to a second orientation, so as to secure the coupling nodule to the hollow roller;

placing the hollow roller into a first position on a surface;

pressing a body part against an upper therapeutic segment of the coupling nodule protruding radially from the hollow roller; and moving the body part relative to the upper therapeutic segment to achieve myofascial release.

18. The method of claim 17, further comprising the following step:

placing a non-coupling nodule on the surface, wherein the first position is adjacent the non-coupling nodule, wherein the non-coupling nodule keeps the hollow roller in the first position.

19. The method of claim 17, further comprising the following steps:

rotating the lower locking segment axially to the first orientation so as to unsecure the coupling nodule from the hollow roller; and pulling the lower locking segment from the receptor opening.

20. The method of claim 17, wherein the receptor opening is elongated to present the elongated axis, wherein the lower locking segment includes a locking protrusion extending radially, wherein in the first orientation the locking protrusion of the lower locking segment is aligned with the elongated axis, wherein in the second orientation the locking protrusion of the lower locking segment is perpendicular to the elongated axis.

* * * * *